US005440840A

United States Patent [19]

Levy

[11] Patent Number: 5,440,840

[45] Date of Patent: Aug. 15, 1995

[54] TRIANGULATED ROOF STRUCTURE

[75] Inventor: Matthys P. Levy, New York, N.Y.

[73] Assignee: Weidlinger Associates, Inc., New York, N.Y.

[21] Appl. No.: 148,453

[22] Filed: Nov. 8, 1993

Related U.S. Application Data

[63] Continuation-in-part of Ser. No. 608,497, Nov. 2, 1990, Pat. No. 5,259,158.

[51] Int. Cl.[6] ..... E04B 7/14

[52] U.S. Cl. ..... 52/83; 52/80.1; 52/81.2; 52/63

[58] Field of Search ..... 52/80.1, 81.2, 83, 63, 52/66

[56] References Cited

U.S. PATENT DOCUMENTS

| | | | |
|---|---|---|---|
| 3,139,957 | 1/1961 | Fuller | 52/83 |
| 3,841,038 | 10/1974 | Geiger | 52/81.2 |
| 4,265,260 | 5/1981 | Gillis . | |
| 4,611,442 | 9/1986 | Richter . | |
| 4,651,496 | 3/1987 | Schildge, Jr. | 52/747 |
| 4,676,033 | 6/1987 | Allen et al. . | |
| 4,682,449 | 7/1987 | Berger . | |
| 4,716,691 | 6/1987 | Allen et al. . | |
| 4,727,688 | 3/1988 | Kida et al. | 52/6 |
| 4,736,553 | 4/1988 | Geiger | 52/81.2 |
| 4,757,650 | 7/1988 | Berger | 52/81.2 |
| 4,831,792 | 5/1989 | Berger . | |
| 4,920,707 | 5/1990 | Moskalink et al. . | |
| 4,942,698 | 7/1990 | Kumagai | 52/6 |
| 5,067,288 | 11/1991 | Takahama et al. | 52/81.2 |
| 5,070,659 | 12/1991 | Brisbin et al. . | |
| 5,257,485 | 11/1993 | Kawaguchi et al. . | |
| 5,259,158 | 11/1993 | Levy | 52/83 |
| 5,355,641 | 10/1994 | Levy | 52/66 |

FOREIGN PATENT DOCUMENTS

| | | |
|---|---|---|
| 394514 | 1/1974 | U.S.S.R. . |
| 605917 | 5/1978 | U.S.S.R. . |
| 1234549 | 5/1986 | U.S.S.R. . |

OTHER PUBLICATIONS

"Reaching for a High-Flying Market", *ENR*, pp. 36–39 (Jul. 14, 1988).

"Kumagai Gumi Retractable Roofed Stadium Technology", Technical Data Specification for Kumagai Gumi Co., Ltd., (May 10, 1990).

*Primary Examiner*—Carl O. Friedman
*Assistant Examiner*—Christopher Todd Kent
*Attorney, Agent, or Firm*—Pennie & Edmonds

[57] ABSTRACT

A triangulated roof structure for supporting a roof that projects in plan a substantially closed curve includes a substantially horizontal outer compression ring, a plurality of tension hoops concentrically arranged within the compression ring at different heights relative to a common reference plane, and a plurality of substantially vertical compression members having upper and lower ends, affixed at their lower ends to each of the tension hoops. The compression members are located so that compression members affixed to a first tension hoop are not radially aligned with compression members affixed to an adjacent tension hoop. The structure also includes a plurality of tension elements interconnecting a compression member affixed to the first tension hoop to a proximal pair of compression members affixed to an adjacent tension hoop and means for securing an outermost tension hoop and the vertical compression members attached thereto to the compression ring. A flexible membrane overlays the tension elements forming a roof for the underlying space which may cover the underlying space in its entirety or, alternatively, may cover a perimeter portion of the underlying space leaving the center portion of the structure uncovered.

33 Claims, 15 Drawing Sheets

TRIANGULATED ROOF STRUCTURE

This application is a continuation-in-part of U.S. application Ser. No. 07/608,497 filed Nov. 2, 1990, now U.S. Pat. No. 5,759,158, which is incorporated herein in its entirety.

BACKGROUND OF THE INVENTION

This invention relates to a triangulated roof structure which supports a roof for an underlying building, arena or stadium. More particularly, it relates to a roof structure formed of a plurality of tension members and compression members arranged in a triangulated manner for supporting a roof that projects in plan a closed non-circular curve.

In recent years, dome roofs have been constructed in a variety of manners. For example, some dome roofs are constructed wherein the roof is supported only by rigid structural members forming the dome without the use of interior columns or beams. Such structures, however, exhibit high aspect ratios, that is, the ratio of surface area to delineated plan area, in order to provide sufficiently low membrane stress. Other roof structures have been constructed wherein a lightweight membrane is supported by air pressure. These structures, while exhibiting low aspect ratios, suffer from numerous disadvantages. The primary disadvantage involves the reliance on a mechanical device, such as a blower, for structural stability. A breakdown in such a mechanical device results in deflations, a common problem for air-supported roofs. In addition, these air-supported roofs require an airtight underlying structure.

Other structures have been built using the principles of catenary suspension typically associated with the construction of suspension bridges. These structures often achieve the low aspect ratio of air-supported roof structures without the detrimental reliance on mechanical devices for structural stability. For example, U.S. Pat. No. 3,139,957 to Fuller illustrates structures in which a series of box frames of polygonal, cylindrical or other forms, of progressively varying sizes are arranged in a concentric array at sequentially different heights above a common plane of reference. These frames are also arranged in vertical overlapping spaced relation to one another to achieve incremental increases or decreases in altitude. Tension elements in the form of flexible cables or wires extend between and are secured to adjacent pairs of box frames in the series, which suspend and anchor the box frames to one another.

Specifically, each frame includes upper chord members and lower chord members which form polygons defining the upper and lower peripheries of the respective frames. Each frame also includes vertical compression columns which extend between the vertices of the polygon formed by the upper chord members and the corresponding vertices of the polygon formed by the lower chord members. A first pair of tension members are supplied which extend downwardly, in a criss-crossing manner, from their point of securement at two adjacent upper vertices of a lower frame to two corresponding adjacent lower vertices of an upper frame whereby successive frames in the series are suspended from one another. These tension members criss-cross when viewed in plan. A second pair of tension members are supplied which extend upwardly, in a criss-crossing manner, from their points of securement at two adjacent lower vertices of the lower frame of the pair to two corresponding adjacent upper vertices of the upper frame in the pair, whereby successive frames in the series are anchored down to one another. These tension elements also criss-cross when viewed in plan. Also, these two pairs of tension members, when viewed in elevation, also criss-cross.

In addition, two other pairs of tension members are supplied which are disposed in radial planes containing the central axis of the structure. The first pair of tension members extend downwardly from their point of securement at two adjacent upper vertices of the lower frame to two radially aligned lower vertices of an upper frame. The second pair of tension members extend upwardly from their points of securement at two adjacent lower vertices of the lower frame to two radially aligned upper vertices of the upper frame. These two sets of tension members criss-cross when viewed in elevation.

The Fuller structures while applicable to a wide range of building shapes, are unnecessarily complicated. Fuller requires a plurality of criss-crossing cables, and consequently, requires complicated attachment structures to accommodate the number of cables arriving at any particular attachment point. Also, due to the number of criss-crossing cables, which serve to suspend, anchor, buttress, resist torque, and resist counter-torquing of the frame, the Fuller structures are unduly redundant.

Further, although the roof structures described in the Fuller patent recognize the tremendous savings of constructing a building using the tensile strength of materials, the use of polygonal frames described in this reference and the number of tension members used to interconnect the series of frames to one another, provide serious drawbacks. The most serious drawback involves the problems encountered when the disclosure of Fuller is applied to structures having a non-circular perimeter. In particular, due to the concentric relation of the frames to one another, the angular relationship of anchoring cables and suspension cables to one another varies at successive frames and may also vary around the perimeter. Therefore, different attachment configurations must be designed for all of the vertices of each of the frames. This significantly increases fabrication costs and construction time.

Another example of a structure using catenary principles is the circular cable truss dome illustrated in U.S. Pat. No. 4,736,553 to Geiger. This truss dome, which is not triangulated, is constructed from a plurality of radially oriented support members. The support members include, in a vertical plane, at least one upper tensioned member forming a top chord, at least one diagonal tensioned member which extends inwardly and downwardly from the upper tensioned member and at least one vertical rigid strut in compression, which is attached at its upper end to the upper tensioned member and attached at its lower end to the diagonal tensioned member. In this arrangement, the tensioned members form two adjacent sides of a triangle while the compression member forms the third side. At least one horizontal tensioned hoop concentric with the outer compression ring is also provided. The tensioned hoop is affixed to the lower end of the compression member.

The radially oriented support members are attached at an outer edge to a continuous compression ring which delineates the area to be covered by the dome. At an inner end, the support members are attached to a horizontal inner tension ring. A flexible membrane is placed on top of the support members to form a roof for the delineated area. In addition, a plurality of valley cables are positioned on top of the flexible membrane, between adjacent support members, which extend between the compression ring and the inner tension ring to maintain the flexible membrane in tension.

This structure, however, does not use triangulated construction. As a result, the structure lacks a degree of lateral stability at the top radial chord of the dome and therefore relies on the flexible membrane for stiffness. Furthermore, due to the radial arrangement of the support members, this structure is only appropriate for use in circular stadiums. Most stadiums or arenas are, however, non-circular.

Roof structures have been developed to support a roof for such non-circular buildings. For example, U.S. Pat. No. 3,841,038 to Geiger relates to a non-circular roof structure which defines an enclosed building space, including a ring which projects in plan substantially to a closed curve having major and minor axes and a plurality of skewed axes of symmetry. In this roof structure, a plurality of sets of rigid arches are connected to the ring to form the roof, with the arches of at least two sets respectively extending in plan substantially parallel to a separate one of the skewed axes of symmetry of the closed curve, and the arches of another set extending in plan substantially parallel to the major or minor axis of the closed curve. These arches impose a funicular load on the ring and support a roof deck structure to form a domed surface.

This structure, while applicable to non-circular structures is unnecessarily complicated, requiring at some points the intersection of up to six arches. This causes extremely complicated attachments at these intersections. Also, this structure is constructed with rigid arches and, therefore, does not efficiently use the tensile strength of building materials and may also result in a roof structure having a high aspect ratio.

Because of the drawbacks highlighted above, none of these prior art roof structures efficiently utilize a triangulated arrangement of tension members and compression members to construct a roof adaptable to a variety of non-circular underlying arenas.

SUMMARY OF THE INVENTION

I have devised a roof structure for a non-circular underlying building structure, such as a stadium, arena or the like, which overcomes the disadvantages and shortcomings of the above-mentioned prior art structures when such structures are applied to non-circular stadiums. Specifically, I have devised a triangulated roof structure for a non-circular underlying structure which reduces the degree of complication of the joint details by approximating the shape of the underlying structure with a series of circular arcs. This triangulated arrangement provides greater redundancy and is better able to handle the nonsymmetric loading conditions which such structures typically encounter.

In accordance with the present invention, a triangulated cable arrangement is disclosed for supporting a roof that projects in plan a closed non-circular curve. The roof defines an enclosed area for an underlying building space having a non-circular perimeter including major and minor axes. The roof structure includes an outer compression ring having a plan which substantially matches the perimeter of the underlying building. A non-circular curve is constructed on the compression ring, using a plurality of circular arcs, which closely approximates the non-circular perimeter of the underlying building space.

The triangulated structure of the present invention also includes a plurality of hoop-like tension members which are concentrically arranged within the non-circular curve at different heights relative to a common reference plane. A plurality of vertical compression members or posts, having upper and lower ends, are affixed at their lower ends at spaced-apart locations on each of the hoop-like tension members. The upper and lower ends of the compression members define upper and lower attachment points or nodes, respectively. The compression members are located on each of these hoop-like tension members, such that each compression member located on a first hoop-like tension member and a proximal pair of compression members on an adjacent hoop-like tension member form, in projection on the plan, the vertices of a substantially isosceles triangle. Similarly, attachment points or nodes are located on the non-circular curve constructed on the outer compression ring such that each node located on the compression ring and a proximal pair of compression members located on an outermost hoop-like tension member also form, in plan, the vertices of a substantially isosceles triangle.

The structure further includes a plurality of tension elements interconnecting each compression member on a first hoop-like tension member to a proximal pair of compression members on an adjacent hoop-like tension member. Tension elements are also provided for interconnecting each compression member on the outermost hoop-like tension member to a proximal pair of nodes on the outer compression ring.

In this manner, the structure, when viewed in plan, appears as a plurality of substantially isosceles triangles arranged within the non-circular curve constructed on the compression ring. Accordingly, the structure is triangulated.

As discussed in Ser. No. 07/608,497 a tension member, such as a cable truss, is provided along the major axis of the non-circular perimeter of the underlying structure. To complete the triangulated structure, the roof structure also includes a plurality of tension elements for interconnecting to the cable truss the compression members that are affixed at their lower ends to an innermost hoop-like tension member to the cable truss. A flexible membrane overlays the tension elements and is attached to the upper nodes of the compression members to form a roof for the underlying structure.

An alternate embodiment replaces the cable truss with a second innermost hoop-like tension member. This second innermost hoop-like tension member is substantially the same as the innermost hoop-like tension member to which the lower ends of the compression members are affixed and is located so that it is connected to the upper ends of the same compression members. In this case the flexible membrane extends inwardly only to the innermost hoop-like tension member leaving an uncovered hole in the middle. This type of structure might cover the spectator areas in a stadium leaving the field areas exposed to the weather, most importantly natural sunlight.

As described above, I have devised a triangulated roof structure for a non-circular underlying building structure in which the plan of the roof structure closely approximates the underlying building structure. In this manner, substantial economy in constructing the triangulated structure is achieved by reducing the variety of unique upper and lower node details that would otherwise occur at the interconnections of each compression member on a first hoop-like tension member to a proximal pair of compression members on an adjacent hoop-like tension member. Since the variety of unique node details is reduced, the same or similar node configurations can be used at a number of upper and lower ends of the compression members through the structure.

BRIEF DESCRIPTION OF THE DRAWINGS

These and other objects, features and advantages of my invention will be more readily apparent from the following detailed description of a preferred embodiment of the invention in which.

DETAILED DESCRIPTION OF THE PREFERRED EMBODIMENTS

Figure 1:
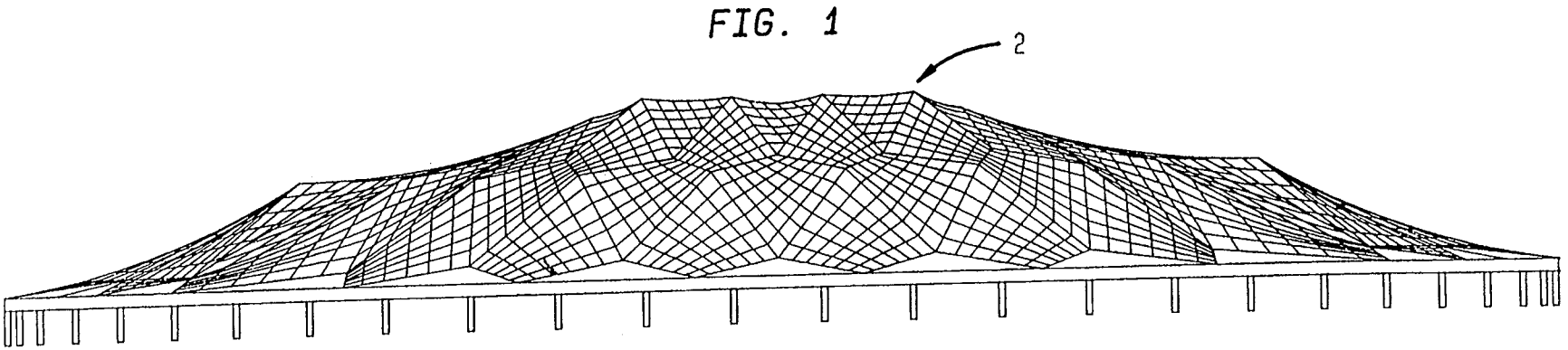
FIG. 1 is a side elevation view of a roof structure in accordance with one embodiment of the present invention.

FIG. 1 illustrates, in side elevation view, a preferred embodiment of a triangulated roof structure, generally designated by the numeral 2, designed in accordance with my invention. Roof structure 2 defines an enclosed area for an underlying building space having a non-circular perimeter. Roof structure 2 includes a flexible membrane constructed from a plurality of diamond shaped panels, which provides a roof for the enclosed space. Cross-sections and plan views of this triangulated roof are shown in FIGS. 2–6.

Figure 2:
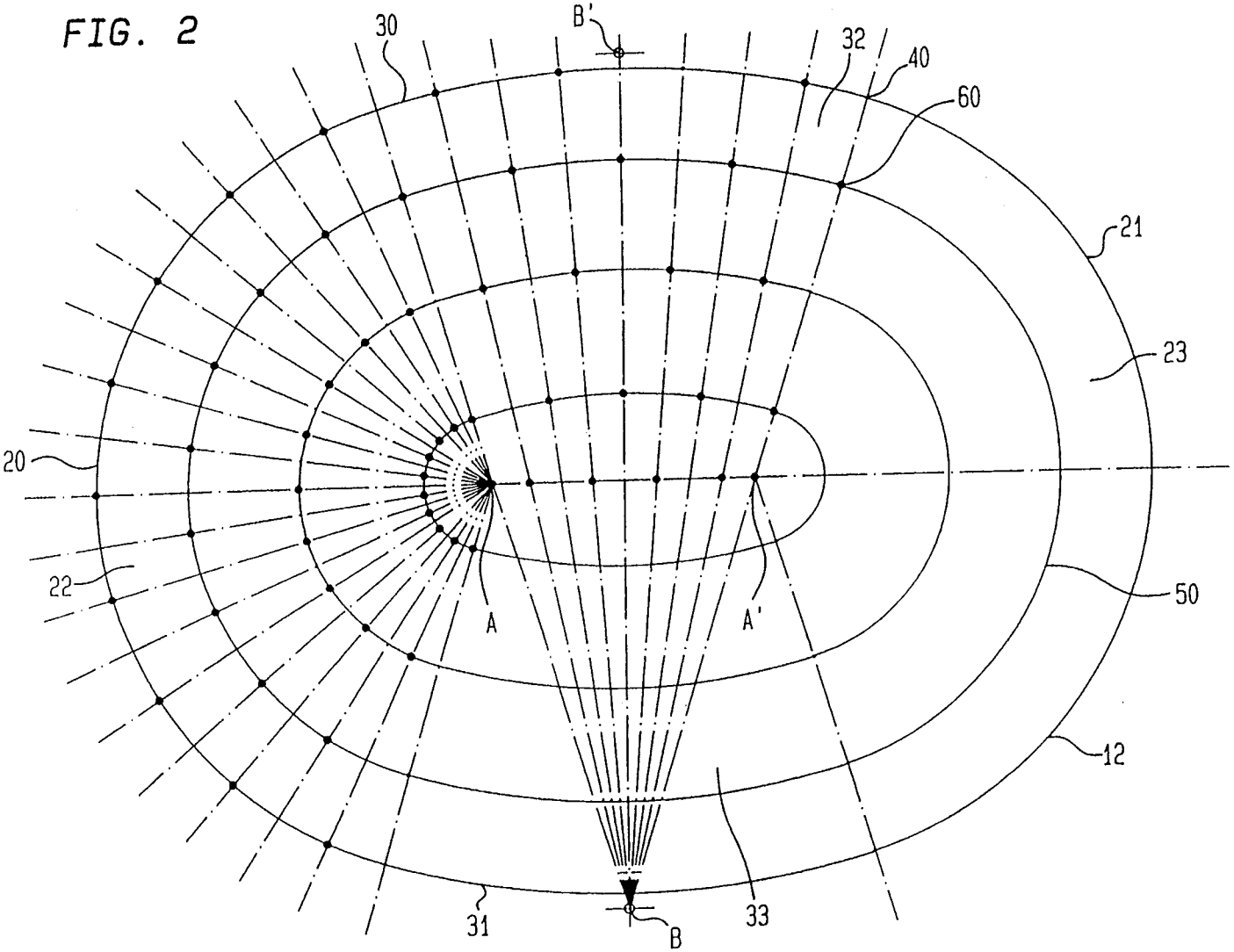
FIG. 2 is a top plan view useful in understanding the present invention.

FIG. 2 illustrates one non-circular configuration for which the present invention may be used, including a compression ring 10 having a non-circular plan which substantially matches the perimeter of an underlying building space 1 having major and minor axes. Constructed on compression ring 10 is a non-circular curve 12 which comprises a plurality of circular arcs. Non-circular curve 12 includes a first pair of circular arcs 20, 21 having their centers A, A' on the major axis of the non-circular curve formed by the perimeter of underlying building structure 1. Centers A, A' of circular arcs 20, 21 are equidistant from the minor axis and on opposite sides. Circular arcs 20, 21 form end sectors 22, 23 for the area enclosed by non-circular curve 12. Non-circular curve 12 further includes a second pair of circular arcs 30, 31 having centers B, B' located on the minor axis of the non-circular curve formed by the perimeter of underlying building structure 1. Centers B, B' of circular arcs 30, 31 are equidistant from the major axis and on opposite sides. Circular arcs 30, 31 form intermediate segments 32, 33. As shown in FIG. 2, first pair of circular arcs 20, 21 and second pair of circular arcs 30, 31 intersect to form non-circular curve 12. Similarly, end sectors 22, 23 combine with intermediate segments 32, 33 to form the area enclosed by non-circular curve 12.

A plurality of hoop-like tension members 50 are concentrically arranged within non-circular curve 12 at different heights relative to a common plane. Vertical compression members 70, having upper and lower ends, are attached at their lower ends to each tension member 50 at spaced-apart locations 60 on the tension member. The upper ends of compression members 70 define upper attachment points or nodes 80 and the lower ends define lower attachment points or nodes 90. Compression members 70 are located on each hoop-like tension member 50 such that a compression member 70 on a first hoop-like tension member 50 and a proximal pair of compression members 70 on an adjacent hoop-like tension member 50 form, in plan, the vertices of a substantially isosceles triangle. Similarly, attachment points (or nodes) 40 are located on outer compression ring 10 such that a node 40 located on outer compression ring 10 and a proximal pair of compression members 70 on an outermost hoop-like tension member 50 form, in plan, the vertices of a substantially isosceles triangle.

Nodes 40 on compression ring 10, lying within end sectors 22, 23 are located at the intersections of non-circular curve 12 with alternating ones of a plurality of radial lines drawn in end sectors 22, 23 through centers A, A' of circular arcs 20, 21, respectively. Similarly, compression members 70 on hoop-like tension members 50, lying within end sectors 22, 23 are located at the intersections of alternating ones of hoop-like tension members 50, with alternating ones of the above-mentioned plurality of radial lines drawn through centers A, A' of circular arcs 20, 21, respectively.

In similar fashion, nodes 40 on compression ring 10, lying within intermediate segments 32, 33 are located at the intersections of non-circular curve 12 with alternating ones of a plurality of radial lines drawn in intermediate segments 32, 33 through centers B, B' of circular arcs 30, 31, respectively. Compression members 70 on hoop-like tension members 50, lying within intermediate segments 32, 33 are located at the intersections of alternating ones of hoop-like tension members 50 with alternating ones of the above plurality of radial lines drawn through centers B, B' of circular arcs 30, 31. In this manner, the triangulated geometry of the present invention is adapted to a wide range of non-circular perimeters to accommodate an underlying structure.

Figure 3:
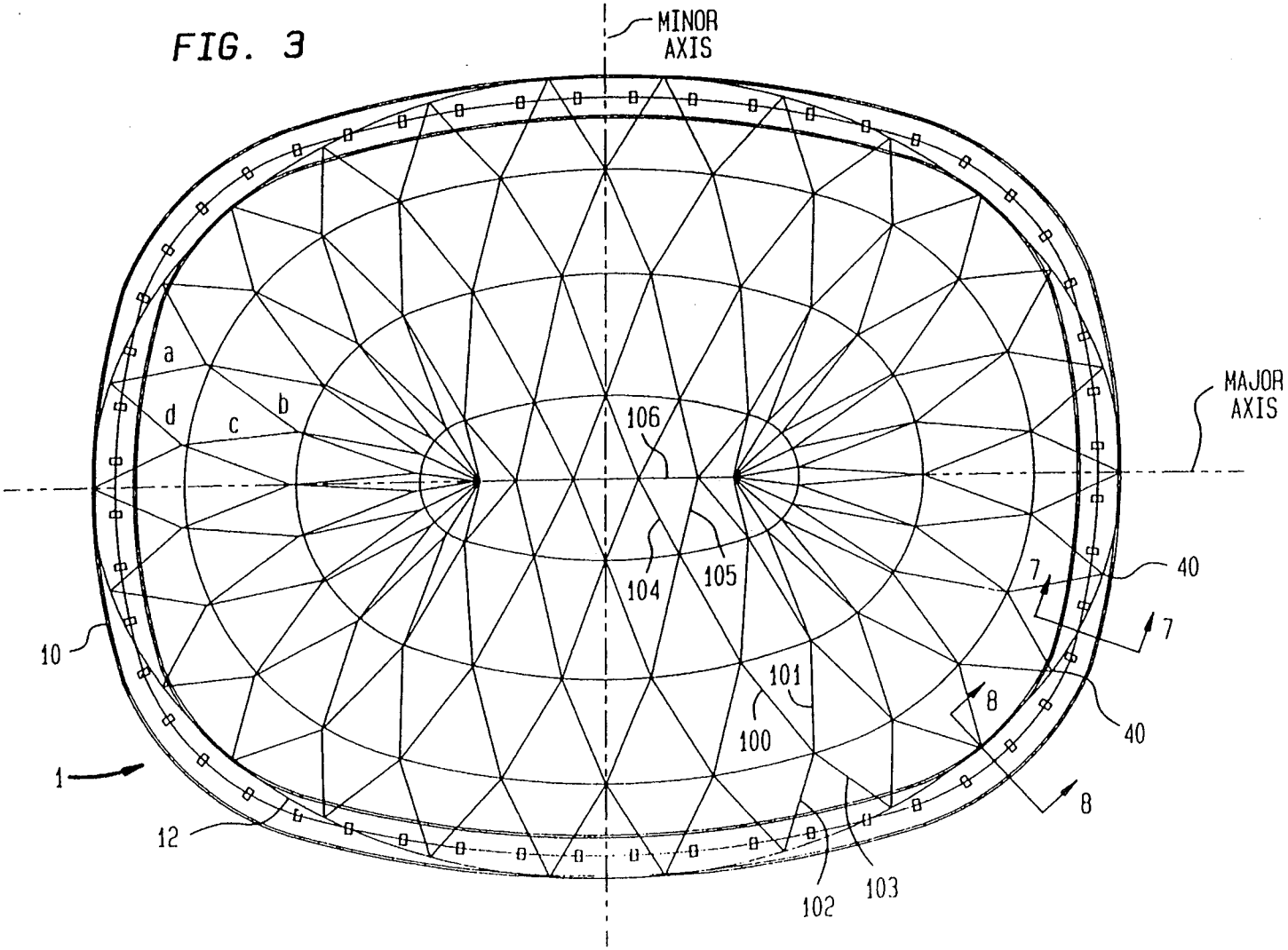
FIG. 3 is a top plan view depicting an upper set of tension elements used in a preferred embodiment of the invention.
Figure 4:
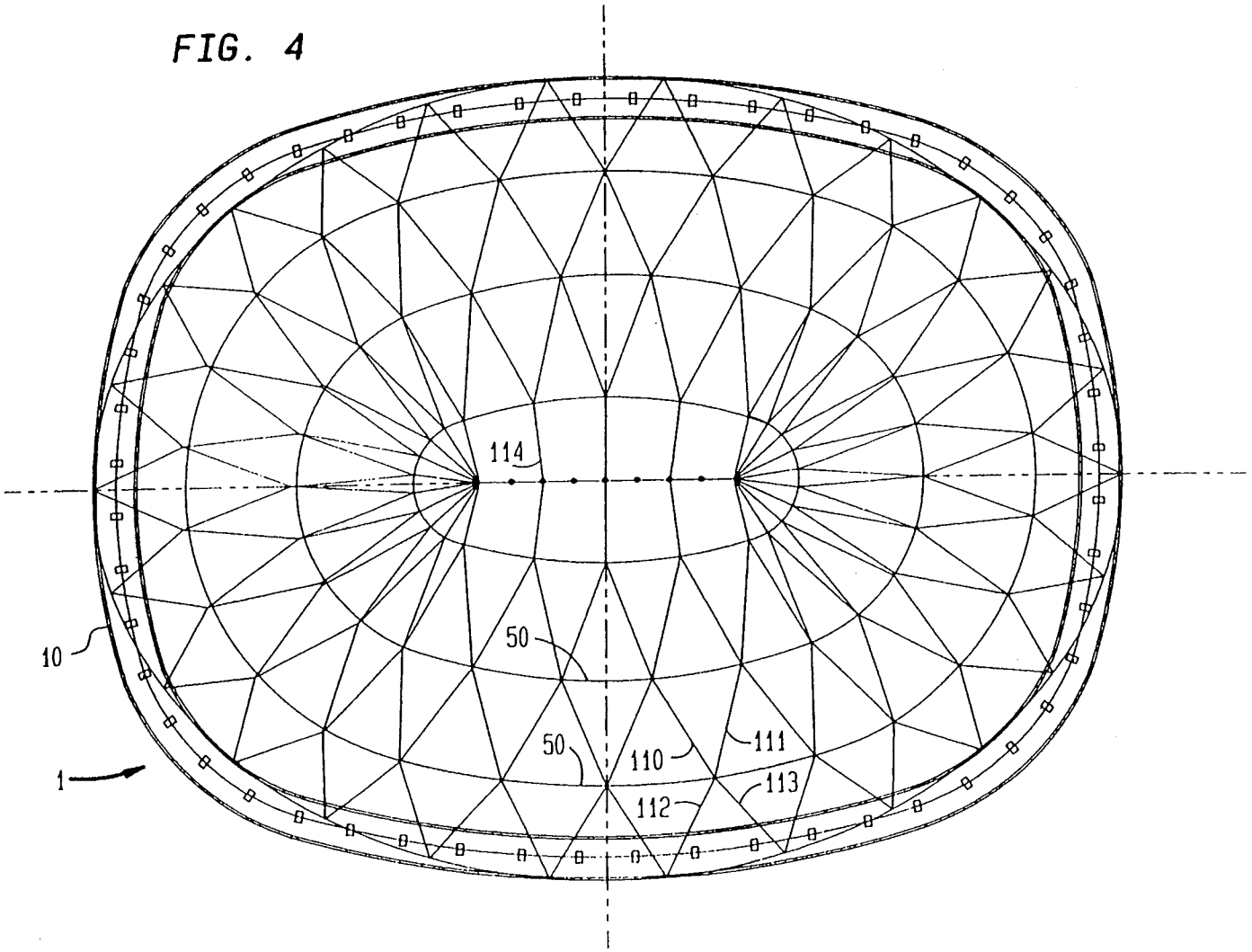
FIG. 4 is a plan view similar to FIG. 3 depicting a set of diagonal tension elements and three hoop-like tension elements used in a preferred embodiment of the invention.
Figure 5:
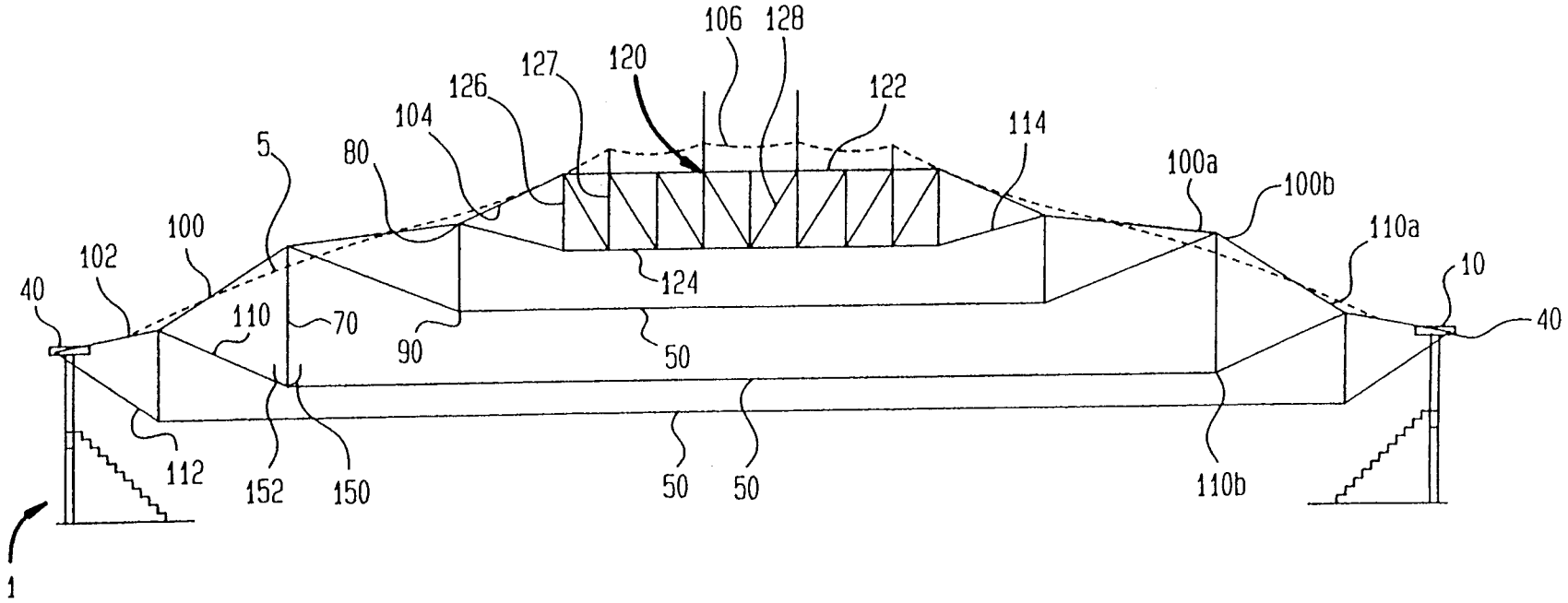
FIG. 5 is a view along the major axis of the non-circular curve in FIG. 3.
Figure 6:
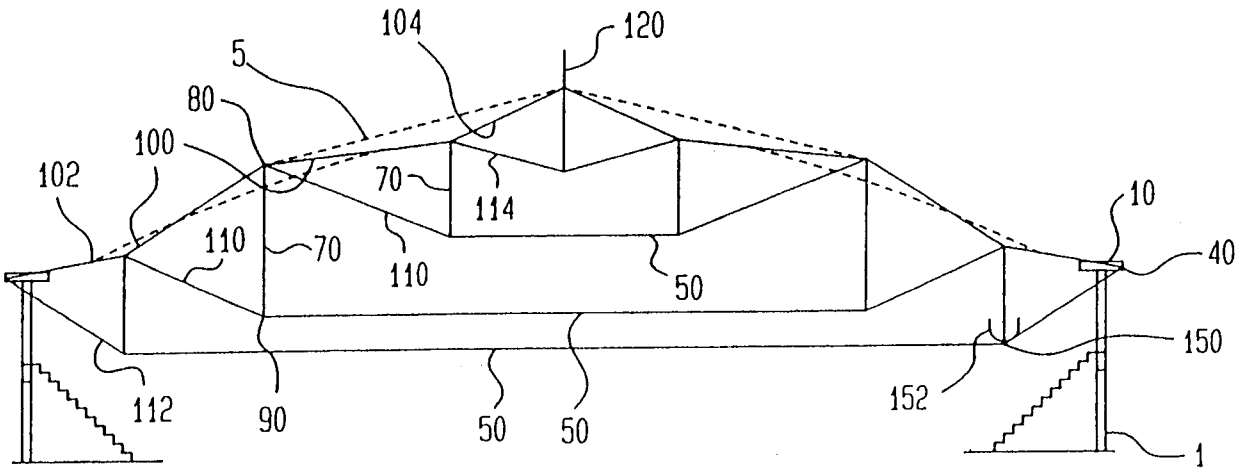
FIG. 6 is a view along the minor axis of the non-circular curve of FIG. 3.

One roof construction according to the present invention is shown in FIGS. 3 and 4, wherein compression ring 10, having an oval shape to match the perimeter of underlying building structure 1 rests upon a number of concrete support columns or other suitable foundation which may extend upward from underlying structure 1. Non-circular curve 12 is constructed on compression ring 10 as described above. A plurality of hoop-like tension members 50 are concentrically arranged within non-circular curve 12 on compression ring 10. As best seen in FIGS. 5 and 6, hoop-like tension members 50 are arranged within compression ring 10 at different heights relative to a common reference plane. A plurality of vertical compression members 70 are affixed at their lower ends to each of hoop-like tension members 50.

A plurality of tension elements are provided for interconnecting each compression member 70 affixed to a first hoop-like tension member 50 to a proximal pair of compression members 70 affixed to an adjacent hoop-like tension member 50. FIG. 3 depicts, in plan, the triangulated arrangement of the tension elements that run between the upper ends of the compression elements. FIG. 4 depicts, in plan, the hoop-like tension members 50 as well as the triangulated arrangement of diagonal tension elements that run between the upper end of one compression element and the lower end of an adjacent compression element.

As best shown in FIGS. 3–6, these tension elements include: a first upper tension member 100 (FIG. 3) extending from upper node 80 of compression member 70 affixed to the first hoop-like tension member 50 to upper node 80 of one of the proximal pair of compression members 70 affixed to the adjacent hoop-like tension member 50; a second upper tension member 101 (FIG. 3) extending from upper node 80 of compression member 70 affixed to the first hoop-like tension member 50 to upper node 80 of the other one of the proximal pair of compression members 70 affixed to the adjacent hoop-like tension member 50; a first diagonal tension member 110 (FIG. 4) extending from upper node 80 of compression member 70 affixed to the first hoop-like tension member 50 to lower node 90 of one of the proximal pair of compression members 70 affixed to adjacent hoop-like tension member 50; and a second diagonal tension member 111 (FIG. 4) extending from upper node 80 of compression member 70 affixed to the first hoop-like tension member 50 to lower node 90 of the other one of the proximal pair of compression members 70 affixed to adjacent hoop-like tension member 50.

The triangulated structure of the present invention also includes means for securing the outermost hoop-like tension member 50 and compression members 70 attached thereto to compression ring 10. In the preferred embodiment, a plurality of tension elements interconnect each compression member 70 affixed to outermost hoop-like tension member 50 to a proximal pair of nodes 40 on compression ring 10.

Preferably, the plurality of tension elements include: a first upper tension member 102 (FIG. 3) extending outwardly from upper node 80 of compression member 70 affixed to outermost hoop-like tension member 50 to one of the proximal pair of nodes 40 on compression ring 10; and second upper tension member 103 (FIG. 3) extending outwardly from upper node 80 of compression member 70 affixed to outermost hoop-like tension member 50 to the other one of the proximal pair of nodes 40 on compression ring 10; a first diagonal tension member 112 (FIG. 4) extending outwardly from lower node 90 of compression member 70 affixed to outermost hoop-like tension member 50 to one of the proximal pair of nodes 40 on compression ring 10; and a second diagonal member 113 (FIG. 4) extending outwardly from lower node 90 of compression member 70 affixed to outermost hoop-like tension member 50 to the other one of the proximal pair of nodes 40 on compression ring 10.

Figure 7:
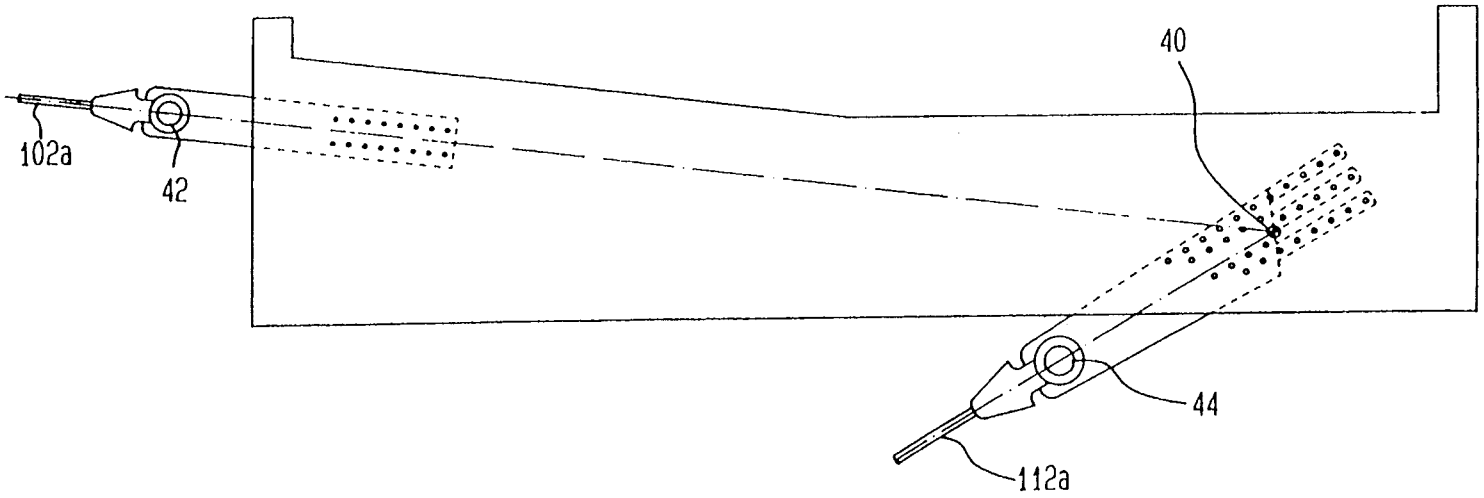
FIG. 7 is a section taken through one node on the compression ring, at line 7—7 of FIG. 3.
Figure 8:
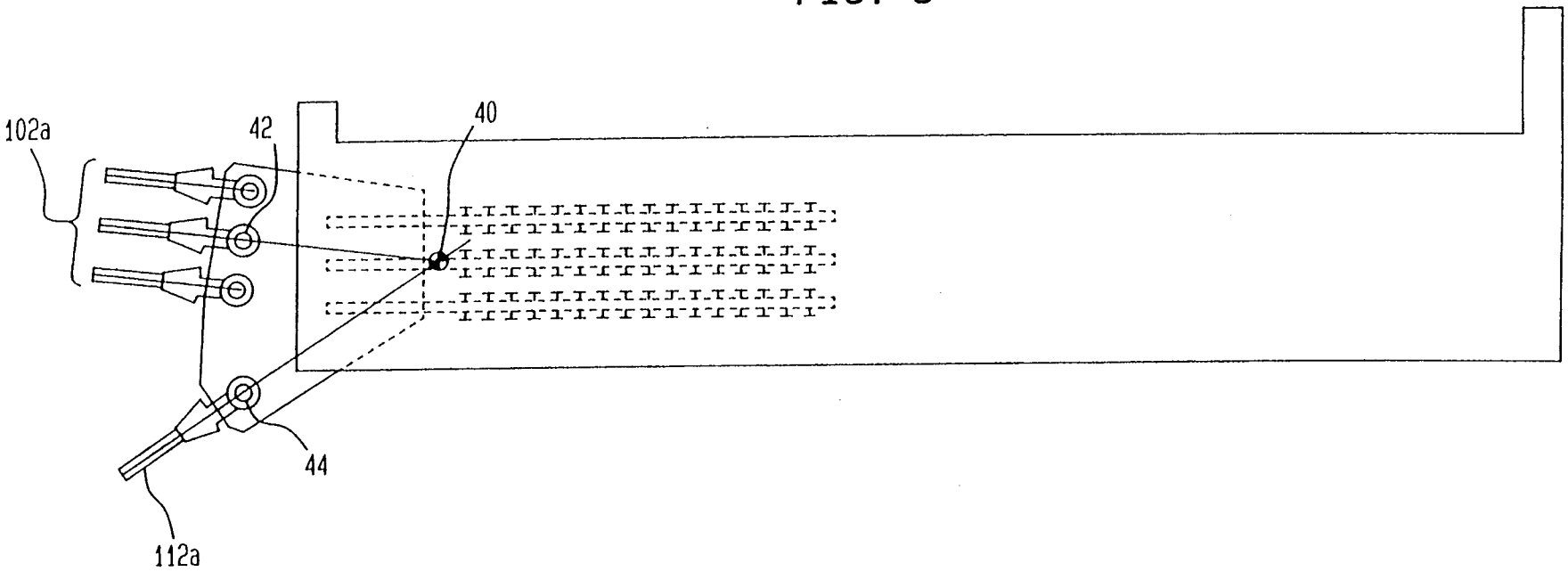
FIG. 8 is a section taken through another node on the compression ring, at line 8—8 of FIG. 3.

As shown in FIGS. 7 and 8, nodes 40 further include attachment members 42 for attaching upper tension members 102, 103 to compression ring 10 and attachment members 44 for attaching diagonal tension members 112, 113 to compression ring 10. Attachment members 42, 44 are designed such that the intersection of the axial centerlines of all tension members attached to compression ring 10 coincide with nodes 40. In the preferred embodiment, compression ring 10 comprises a concrete box girder. Since nodes 40 lie on non-circular curve 12 constructed on compression ring 10, the location of nodes 40 on compression ring 10 varies around non-circular curve 12. Accordingly, the location of attachment members 42, 44 also varies around compression ring 10.

Figure 9:
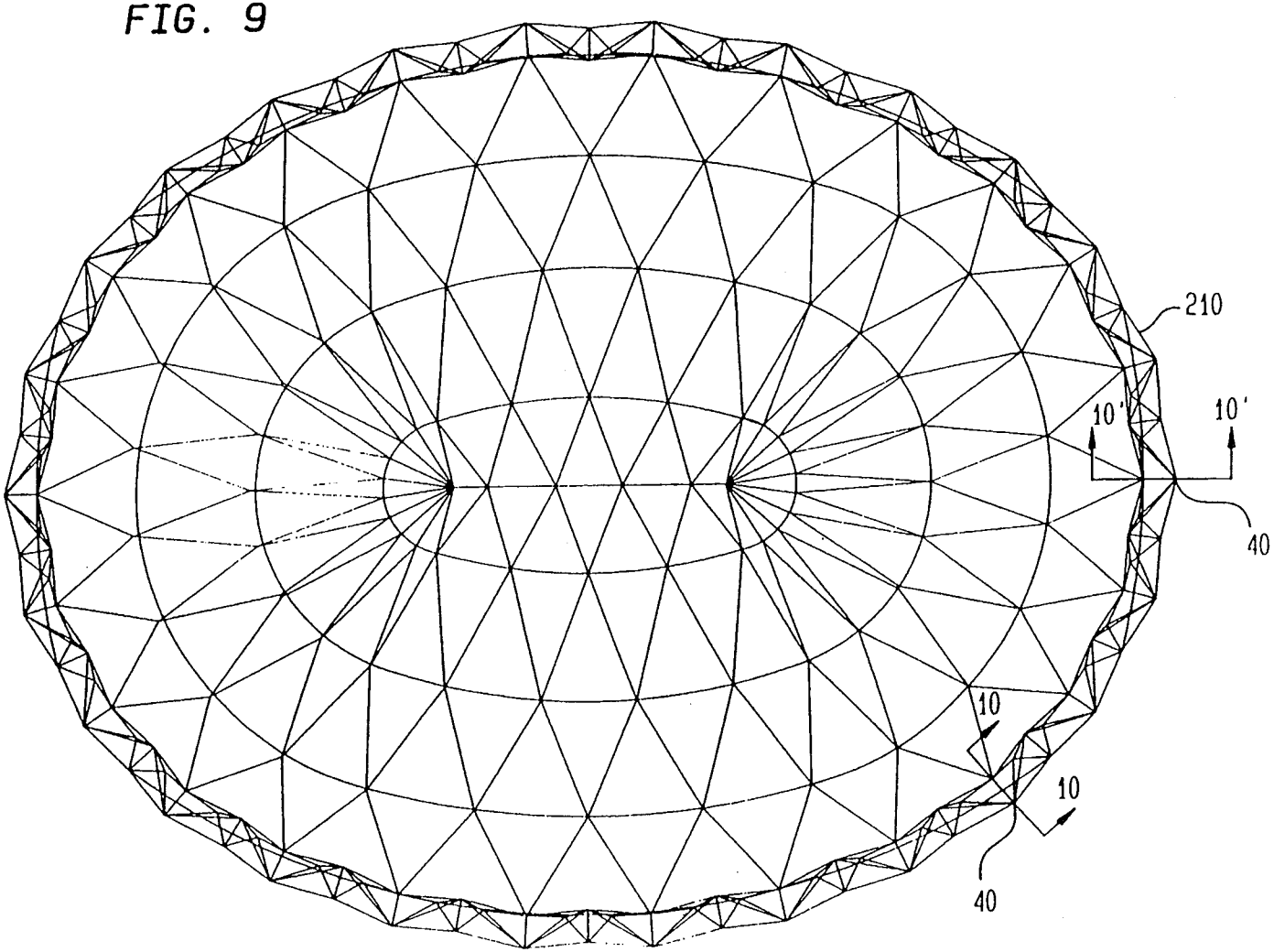
FIG. 9 is a top plan view similar to FIG. 3 depicting an alternate compression ring comprising a triangular truss.
Figure 10:
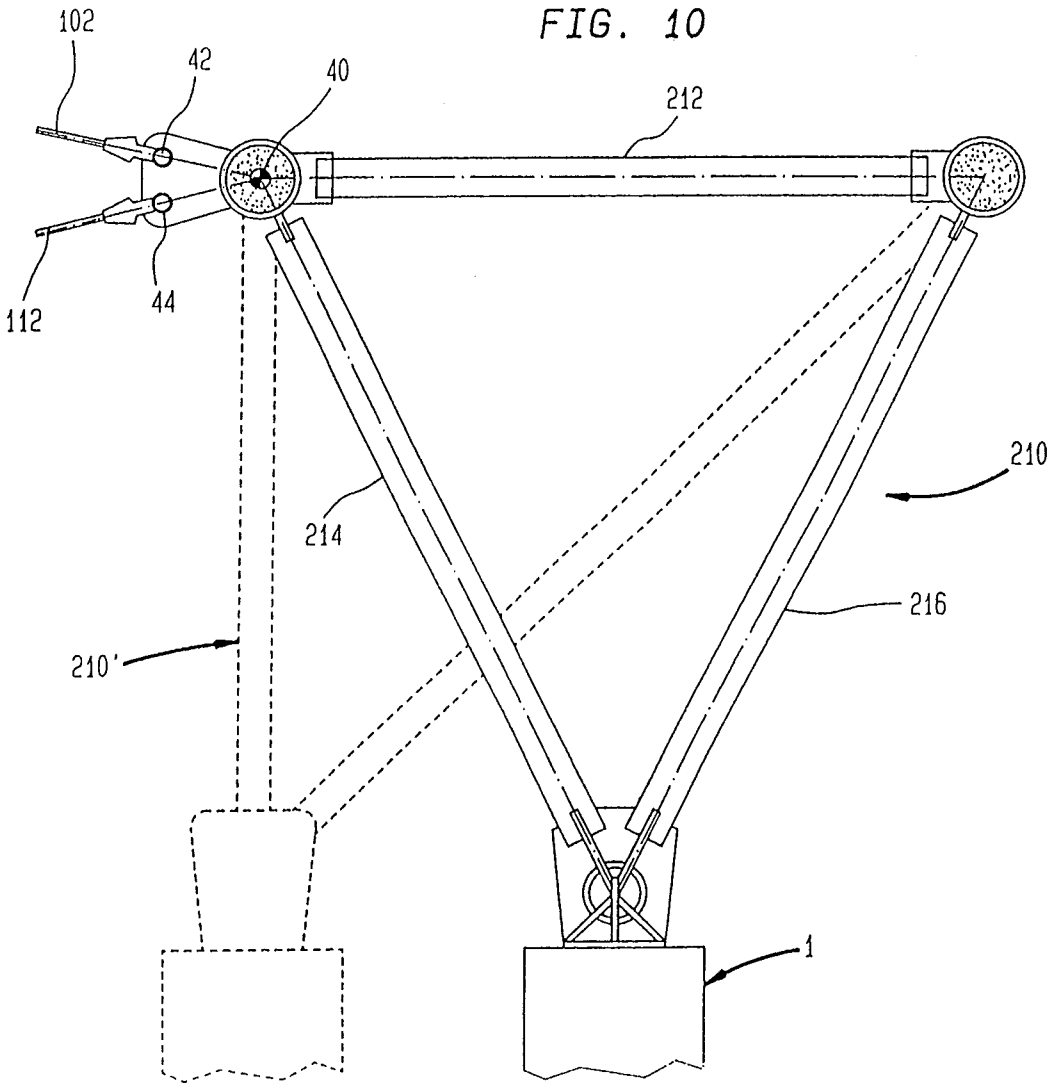
FIG. 10 is a section through lines 10—10 and 10'—10' of FIG. 9.

In an alternate embodiment, illustrated in FIGS. 9 and 10, compression ring 10 comprises triangular truss 210. Triangular truss 210 further includes horizontal top truss 212 and a pair of inclined side trusses 214, 216 which are secured to top truss 212 and which extend downward from top truss 212 to a common point. The shape of triangular truss 210 varies around the perimeter of the underlying structure to accommodate the change in the location of nodes 40 relative to the underlying structure, due to the approximation of the perimeter by non-circular curve 12. Truss 210 in FIG. 10 illustrates the shape of the truss when node 40 lies inside a support column of underlying structure 1, such as at line 10—10 of FIG. 9. Truss 210' illustrates the shape of the truss when node 40 lies directly above a support column of underlying structure 1, such as at line 10'—10' of FIG. 9.

In a preferred embodiment, a cable truss 120, shown in FIG. 5, is positioned along the major axis between centers A, A' of circular arcs 20, 21 to incorporate a triangulated geometry into a non-circular configuration. Cable truss 120 preferably includes an upper tension member forming a top chord 122, a lower tension member parallel to top chord 122 forming a bottom chord 124, a plurality of compression members 126 and 127, of varying heights, having upper and lower ends. The lower ends of compressions members 126, 127 are affixed to bottom chord 124. The upper ends of compression members 126 are affixed to top chord 122, while compression members 127 are affixed to top chord 122 at some point below their upper ends. Cable truss 120 also includes a plurality of diagonal tension members extending from the point at which a first compression member 126, 127 is affixed to top chord 122 to the lower end of an adjacent compression member 126, 127, forming diagonal chords 128.

Also, a plurality of tension elements are provided for interconnecting an innermost hoop-like tension member 50 to cable truss 120. In the preferred embodiment, these tension elements interconnect each compression member 70 affixed to innermost hoop-like tension member 50 to at least one compression member 126, 127 of cable truss 120. Preferably, as shown in FIGS. 3 and 4, these tension elements include: at least one upper tension member 104 (FIG. 3) extending inwardly from upper node 80 of compression member 70 affixed to innermost hoop-like tension member 50 to the upper end of at least one compression member 126, 127 of cable truss 120 and at least one diagonal tension member 114 (FIG. 4) extending inwardly from upper node 80 of compression member 70 affixed to innermost hoop-like tension, member 50 to the lower end of at least one compression member 126, 127 on cable truss 120.

In order to provide a roof which has an overall downward slope, an uppermost tension member 106 (FIG. 3) is positioned along the major axis between A, A', above cable truss 120 and is connected to the upper ends of compression members 127.

One particular advantage of the present invention is that the number of structural members in tension is maximized to more efficiently utilize the tensile property of the building materials. Therefore, the structural members that are in tension are preferably formed of flexible materials such as cables. For example, hoop-like tension members 50, upper tension members 100–106, diagonal tension members 110–114, top chord 122, bottom chord 124, and diagonal chord 128 of cable truss 120, preferably comprise cable such as wire strand, or wire rope. In the preferred embodiment, upper tension members 100–106 comprise a plurality of cables which may drop off toward the center of the structure. Compression members 70 as well as compression members 126, 127 of cable truss 120 are preferably rigid posts such as steel pipe.

Figure 11:
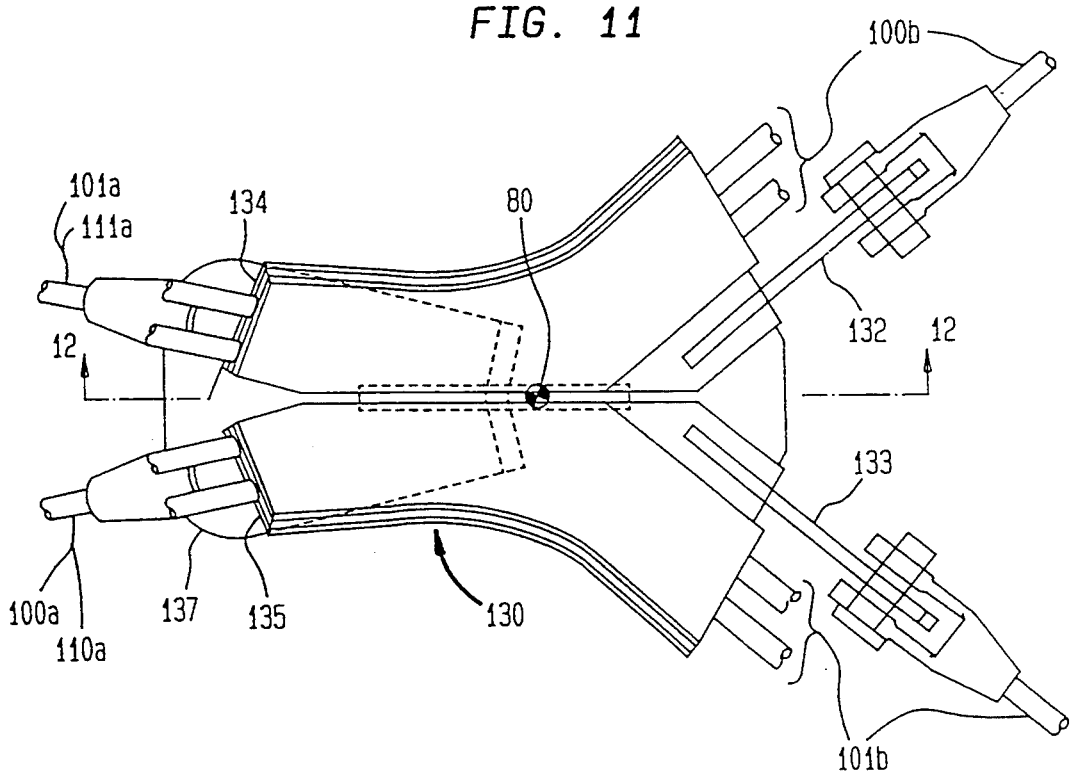
FIG. 11 is a top plan view of an upper node of a compression member.
Figure 12:
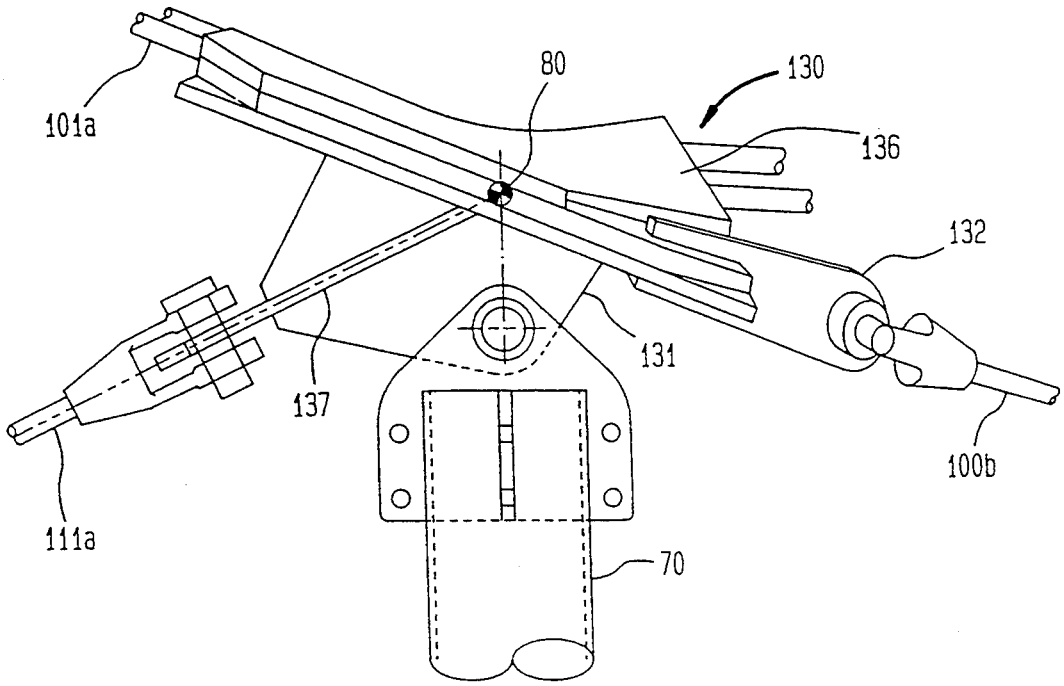
FIG. 12 is a section through line 12—12 of FIG. 11.

FIGS. 11 and 12 illustrate an upper attachment 130 which may be affixed to the upper end of compression members 70. Upper attachment 130 is designed to attach to a compression member 70 first ends 100*a*, 101*a* of a first set of upper tension members 100, 101, second ends 100*b*, 101*b* of a second set of upper tension members 100, 101, and first ends 110*a*, 111*a* of a set of diagonal tension members 110, 111. Upper attachment 130 includes: a first attachment plate 131 for attaching the upper end of compression member 70; a pair of attachment plates 132, 133 located on an outer side of compression member 70 for attaching second ends 100*b*, 101*b* of upper tension members 100, 101, which extend inwardly from upper nodes 80 of a proximal pair of compression members 70 located on an outer adjacent hoop-like tension member 50; a second pair of attachment plates 134, 135 located on an inner side of compression member 70 for attaching first ends 100*a*, 101*a* of upper tension members 100, 101, which extend inwardly from upper node 80 of compression member 70 to upper nodes 80 of a proximal pair of compression members 70 located on an inner adjacent hoop-like tension member 50; a saddle-like plate 136 positioned above attachment plates 134, 135 and conforming to the geometry therebetween for providing additional structural support to the attachment of upper tension members 100, 101; and a second attachment plate 137 for attaching first ends 110*a*, 111*a* of diagonal tension members 110, 111, which extend inwardly from upper node 80 of compression member 70 to lower nodes 90 of a proximal pair of compression members 70 located on an inner adjacent hoop-like tension member 50. Significantly, upper attachment 130 is designed such that the intersection of the axial centerlines of all tension members 100, 101, 110, 111 and compression member 70 attached thereto coincide with upper node 80.

Figure 13:
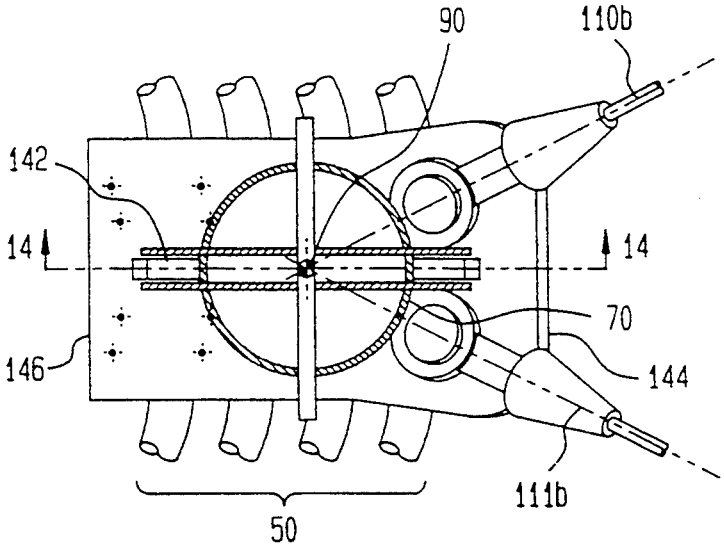
FIG. 13 is a top plan view of a lower node of a compression member.
Figure 14:
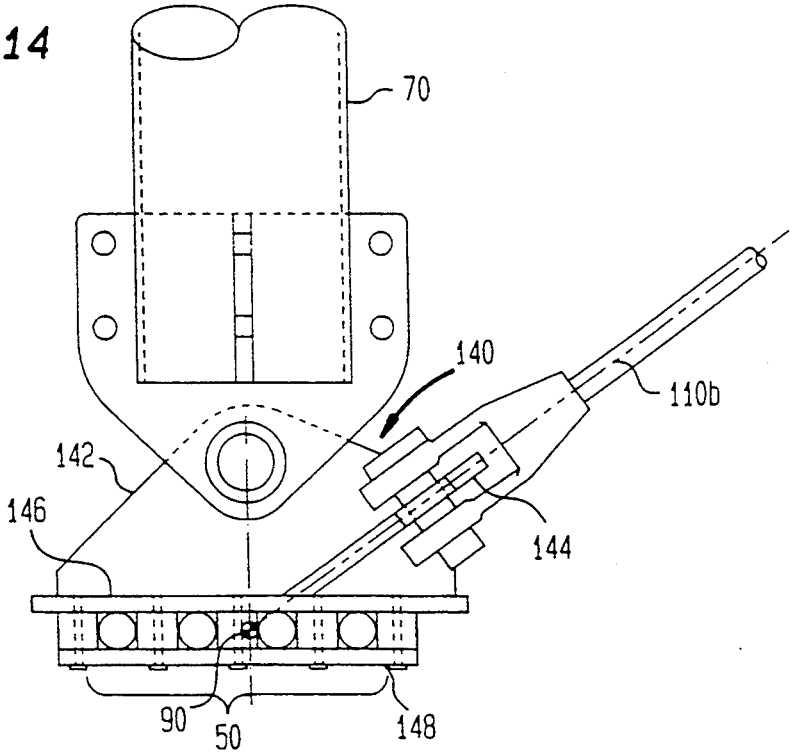
FIG. 14 is a section through line 14—14 of FIG. 13.

FIGS. 13 and 14 illustrate a lower attachment 140 which may be affixed to the lower end of compression member 70 and which in turn affixes the lower end of compression member 70 to hoop-like tension member 50 at nodes 60. Lower attachment 140 includes: a first plate 142 for attaching the lower end of compression member 70; a second attachment plate 144 located on an outer side of compression member 70 for attaching the second ends 110*b*, 111*b* of diagonal tension members 110, 111, which extend inwardly from upper nodes 80 of a proximal pair of compression members 70 located on an outer adjacent hoop-like tension member 50; and a third attachment plate 146 for securing the lower end of compression member 70 to hoop-like tension members 50. A plate 148, located beneath plate 146, may also be included to secure the lower end of compression member 70 to hoop-like tension member 50. Lower attachment 140 is designed such that the axial centerlines of diagonal tension members 110, 111 and compression member 70 as well as the radial centerline of hoop-like tension member 50 attached thereto coincide with lower node 90.

Overlying upper tension members 100–106 of the triangulated support structure is a flexible membrane 5 serving as a roof for the underlying structure. Membrane 5 may be formed by Teflon TM -coated fiberglass, silicone coated polyester, or corrugated steel, although it is contemplated that other materials such as canvas may also be used. Preferably, however, membrane 5 is constructed of Teflon TM -coated fiberglass.

In the preferred embodiment, membrane 5 comprises a plurality of diamond-shaped panels, such as panel abcd shown in FIG. 3. The vertices of these roof panels coincide with upper nodes 80 of compression members 70 and are secured to upper attachments 130. As such, these diamond shaped panels form hyperbolic paraboloids. This is best illustrated in FIG. 1. Significantly, the hyperbolic paraboloid shape the roof panels take when secured to upper nodes 80 of compression members 70 contributes to the structural stiffness of these panels, without the use of additional cables on top of membrane 5.

For convenience, a network of catwalks 150 can be constructed on hoop-like tension members 50 to provide for maintenance and installation personnel, as well as to provide mounting for service lighting, speakers and rigging for special events. Catwalks 150 may have handrails 152 on either side to provide safety.

The uniqueness of the cable truss structure designed in accordance with the present invention is best demonstrated by FIG. 1. In particular, the triangulated location of compression members 70 on hoop-like tension members 50 in an offset relation, gives rise to the unique hyperbolic paraboloid shape of the roof panels when attached to upper nodes 80 of compression members 70. The triangulated structure provides an added degree of stability over prior art structures while minimizing the number of structural members required. Also of particular importance is the tent-like appearance of the overall structure, due primarily to the employment of cable truss 120 along the major axis.

Figure 15:
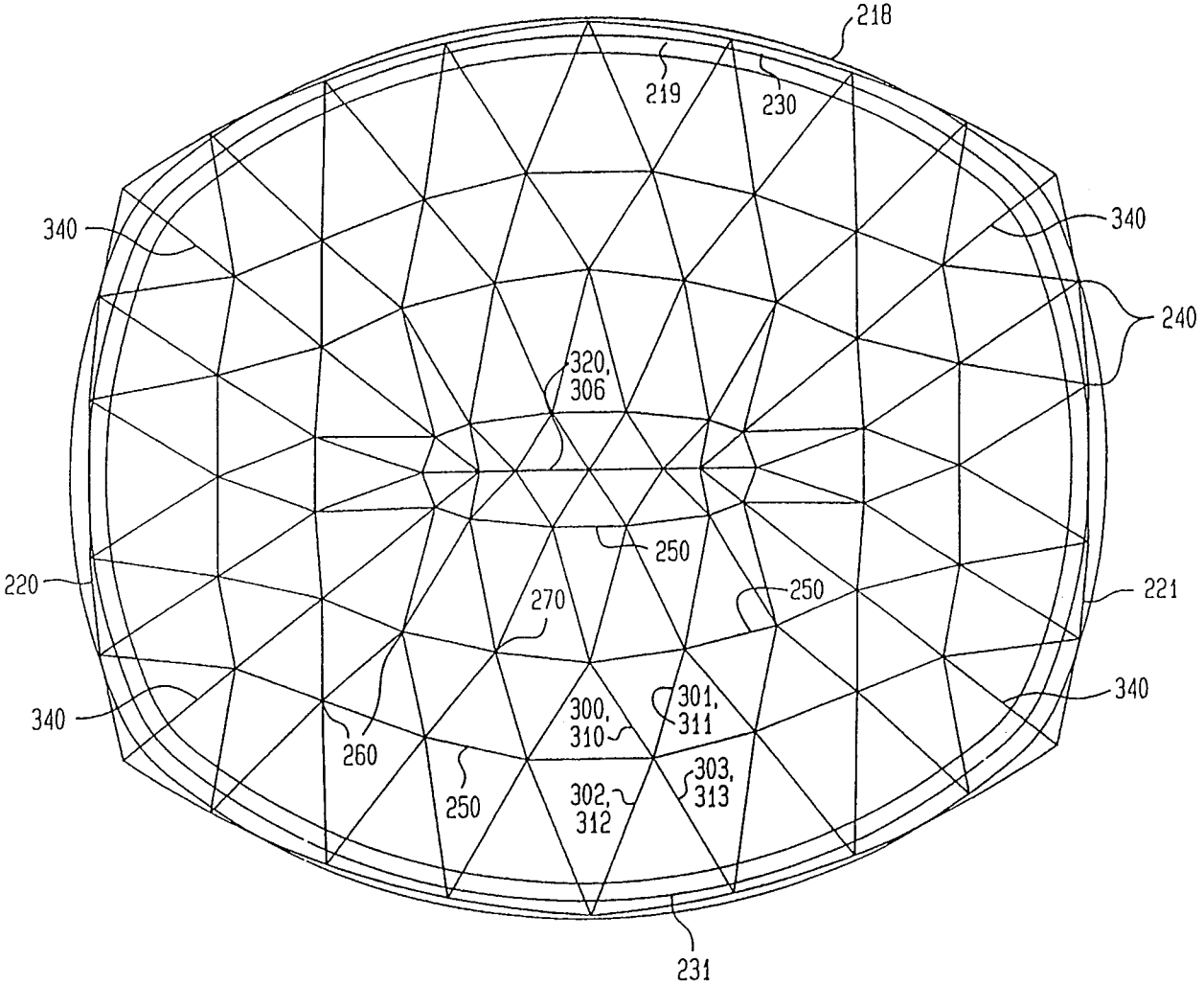
FIG. 15 is a top plan view depicting an alternate embodiment of the roof structure shown in FIGS. 3 and 4.

FIG. 15 illustrates another non-circular configuration for which the present invention may be used, in which like elements are numbered in a like manner. This embodiment also includes a compression ring 218 having a non-circular plan which substantially matches the perimeter of the underlying building space. In this embodiment, however, a discontinuous non-circular curve 219 is constructed on compression ring 218 from a plurality of circular arcs, wherein each of the arcs has the same radius. Non-circular curve 219 includes a first pair of circular arcs 220, 221 having their centers on the major axis of the non-circular curve formed by the perimeter of the underlying building structure. The centers of circular arc 220, 221 are equidistant from the minor axis and on opposite sides. Non-circular curve 219 further includes a second pair of circular arcs 230, 231 having their centers located on the minor axis of the non-circular curve formed by the perimeter of the underlying building structure. The centers of circular arc 230, 231 are equidistant from the major axis and on opposite sides. First pair of circular arcs 220, 221 and second pair of circular arcs 230, 231 intersect to form discontinuous non-circular curve 219.

A plurality of hoop-like tension members 250 are concentrically arranged within non-circular curve 219 at different heights relative to a common plane. Nodes 240 are located at the intersections of the above-described circular curves which make up non-circular curve 219. Additional nodes 240 are evenly spaced between the nodes located at these intersections. Vertical compression members 270 having upper and lower ends are attached at their lower ends to each hoop-like tension member 250 at spaced-apart locations 260 on the tension members. Compression members 270 are located on each hoop-like tension member 250 such that a compression member 270 on a first hoop-like tension member 250 and a proximal pair of compression members 270 on an adjacent hoop-like tension member 250 form, in plan, the vertices of a substantially isosceles triangle. Compression members 270 on an outermost hoop-like tension member 250 are located such that a node 240 located on outer compression ring 218 and a proximal pair of compression members 270 on the outer most hoop-like tension member 250 form, in plan, the vertices of a substantially isosceles triangle. A cable truss 320 is positioned along the major axis to complete the triangulated structure.

As described with respect to the embodiment shown in FIGS. 3 and 4, the structure includes upper and diagonal tension members 300, 301 and 310, 311, respectively, which interconnect each compression member 270 on a first hoop-like tension member 250 to the proximal pair of compression members 270 on an adjacent hoop-like tension member 250. Also, upper and diagonal tension members 302, 312 interconnect a compression member 270 located on outermost hoop-like tension member 250 to a proximal pair of nodes 240 on outer compression ring 218. Finally, tension elements are provided to interconnect compression members 270 on an inner most hoop-like tension member 250 to cable truss 320.

In this embodiment, all of the upper attachments on any one hoop-like tension member 250 are identical since the angular relation of tension members arriving at an upper node are identical for each compression member on the hoop. Similarly, all of the lower attachments are identical. Only the upper and lower attachments for compression members lying along lines 340 are different for each hoop.

Figure 16:
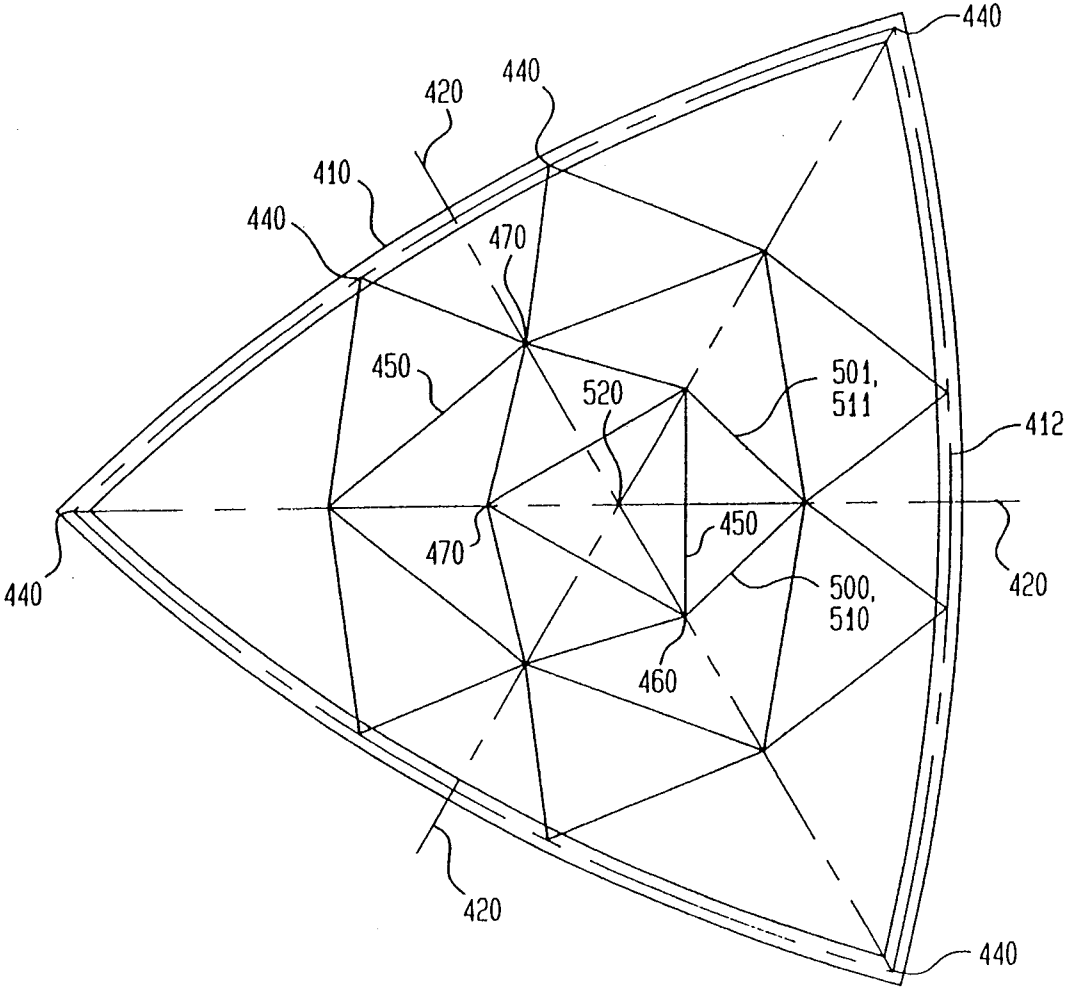
FIG. 16 is a top plan view of another embodiment of the present invention.

FIG. 16 illustrates another non-circular configuration for which the present invention may be used, where like elements are designated by like numerals. This embodiment is drawn specifically to an underlying structure having a substantially triangular perimeter. A compression ring 410 is provided having a plan which substantially matches the triangular perimeter of the underlying building space. In this embodiment, a discontinuous non-circular curve 412 is constructed from three circular arcs having the same radius. The centers of these arcs are located on meridians 420 which are drawn from each vertex of the triangle to a middle point of the opposite side of the triangle. In this manner, non-circular curve 412 is constructed which substantially matches the perimeter of the underlying building space.

Nodes 440 are located at each vertex of the triangle and additional nodes 440 are evenly spaced along non-circular curve 412 between each vertex. A plurality of hoop-like tension members 450 are concentrically arranged within non-circular curve 412 at different heights relative to a common plane. Vertical compression members 470 are attached at their lower ends to each hoop-like tension member at spaced-apart locations 460 on the tension members such that a compression member 470 on a first hoop-like tension member 450 and a proximal pair of compression members 470 on an adjacent hoop-like tension member 450 form, in plan, the vertices of a substantially isosceles triangle.

Upper and diagonal tension members 500, 501 and 510, 511, respectively, are provided which interconnect compression member 470 on the first hoop-like tension member 450 to the proximal pair of compression members 470 located on the adjacent hoop-like tension member 450. Also, upper and diagonal tension members are provided which interconnect each compression member 470 on an outermost hoop-like tension member 450 to at least one node 440 on outer compression member 410.

In addition, a tension element 520, such as a post, is provided at a center point of the triangle. Tension elements are also provided which interconnect each compression member 470 on an innermost hoop-like tension member 450 to inner tension element 520. In this manner, a triangulated structure is achieved wherein the upper and lower attachments along each hoop-like tension member are the same.

Figure 17:
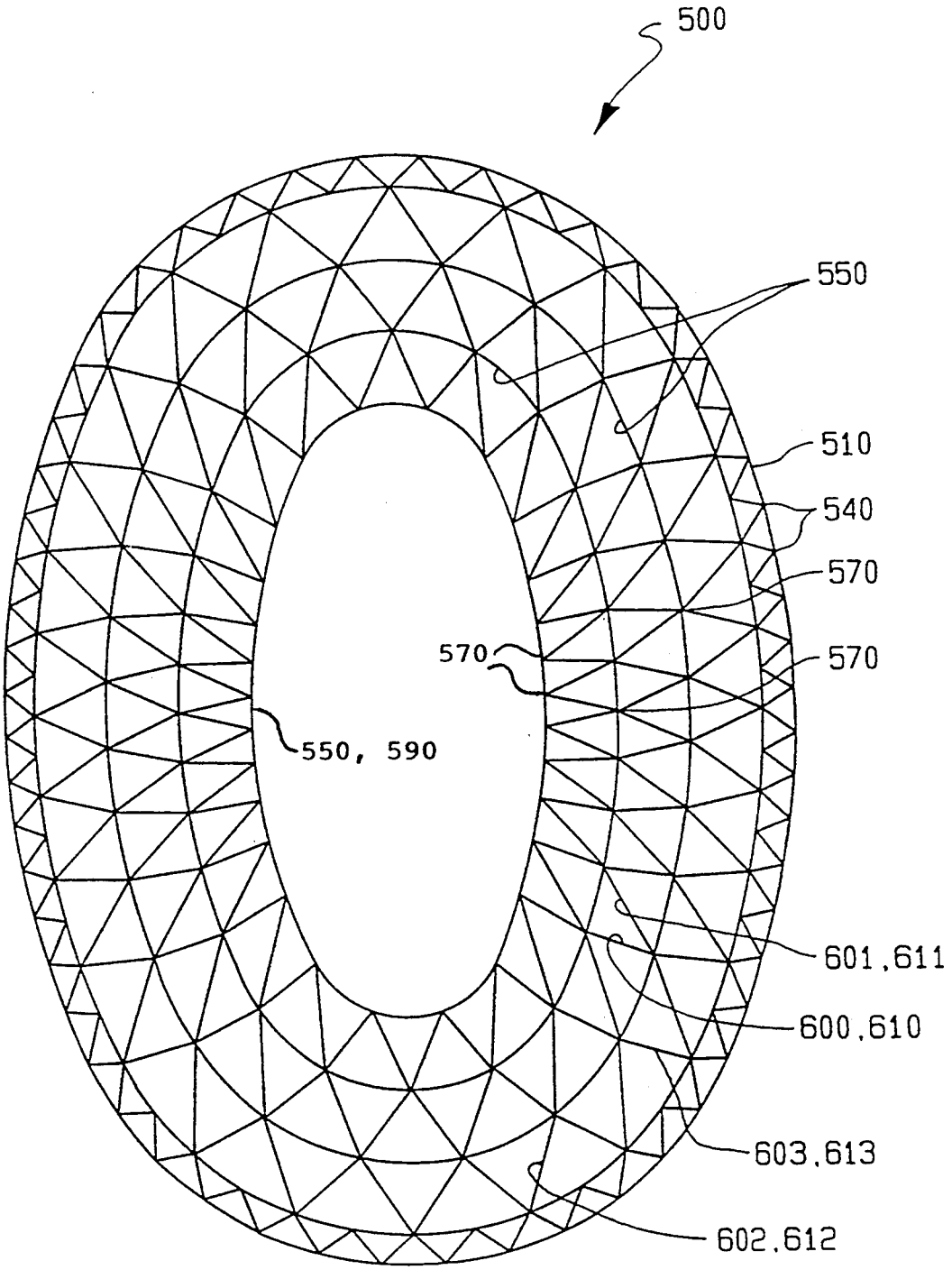
FIG. 17 is a top plan view of yet another embodiment of the present invention.

FIG. 17 illustrates another embodiment of the triangulated roof structure wherein the roof structure does not cover the plan of the building space in its entirety. Specifically, a roof structure 500 covers a perimeter portion of the building space leaving the center area uncovered. This type of structure could function to cover the "stand" area of a stadium leaving the "field" area exposed. As above, like elements to the above described embodiments are designated by like numerals.

A compression ring 510 is provided having a plan which substantially matches the perimeter of the underlying building space. The underlying plan illustrated is of a continuous, non-circular shape. However, the plan may comprise discontinuous arcs to form perimeters of discontinuous shape (e.g., triangular shapes) or may comprise a continuous, circular shape. The non-circular continuous curve depicted in FIG. 17 comprises circular arcs similar to that described with respect to FIG. 2.

A plurality of hoop-like tension members 550 are concentrically arranged within compression ring 510 at different heights relative to a common plane. Vertical compression members 570, having upper and lower ends, are attached at their lower end to each tension member 550 at spaced-apart locations on the tension member. Compression members 570 are located on each hoop-like tension member such that a compression member on a first hoop-like tension member and a proximal pair of compression members on an adjacent hoop-like tension member form, in plan, the vertices of a substantially isosceles triangle. Similarly, attachment points (nodes) 540 are located on outer compression ring 510 such that a node 540 located on outer compression ring 10 and a proximal pair of compression members 570 on an outermost hoop-like tension member 550 form, in plan, the vertices of a substantially isosceles triangle. The arrangement of these compression members relative to the tension members is similar to that described with respect to FIG. 2.

Upper and diagonal tension members 600, 601 and 610, 611, respectively, are provided which interconnect compression member 570 on the first hoop-like tension member 550 to the proximal pair of compression members 570 located on adjacent hoop-like tension members 550. Similarly, upper and diagonal members 602, 612 and 603, 613, are provided which interconnect compression member 570 on an outermost hoop-like tension member 550 to outer compression ring 510.

This embodiment eliminates the need for a center truss (see FIG. 3, element 106) by use of a second innermost hoop-like tension member 590. It is substantially the same as the innermost hoop-like tension member 550 but is connected to the upper ends of the vertical compression members 570. The innermost hoop-like tension member 590 acts as the center truss by interconnecting the upper end of each compression member 570 affixed to the innermost hoop-like tension member 550.

The elimination of the central cable truss allows the central portion of the building structure to be exposed and, thus, create an outdoor playing field environment or the like. Unlike the closed, tent-like structure described with respect to the closed roof structure, the roof structure of the instant embodiment will appear as an oblong torus wherein the covered portions are maintained about the perimeter of the structure. As with the above described embodiments, the roof structure is covered with a flexible membrane to the extent that it is covered.

While the drawings illustrate roof structures for a non-circular underlying structure, it is apparent that the triangulated cable arrangement and the open center of FIG. 17 may also be employed in circular stadiums or arenas. In the case of a circular stadium or arena, a single tension member, such as an inner hoop-like tension member or single post, is employed at the center of the circle. As previously described with respect to a non-circular configuration, compression members on circular tension hoops and nodes on a circular compression ring are located at the intersections of alternating ones of a plurality of radial lines drawn through the center of the circle with alternating ones of the tension hoops and a circular curve constructed on the compression ring. Compression members define upper and lower nodes as described before, and upper tension members as well as diagonal tension members interconnect each compression member on a first tension hoop to a proximal pair of compression members on an adjacent tension hoop. In this manner, a triangulated circular roof structure is constructed. Again, the center of this circular roof structure can be made open so as to form an annular roof structure. This is achieved by replacing the single tension member at the center with a pair of innermost circular tension members of the desired diameter that are affixed to opposite ends of the compression member on the inside of the annulus.

In a similar manner, an eye-shaped roof structure may also be constructed. In this case, a pair of circular arcs, each having a center located on the minor axis, equidistant from the major axis and on opposite sides, intersect to form a discontinuous eye-shaped curve which approximates the perimeter of the underlying structure. A tension member, such as a cable truss, is positioned along the major axis and a plurality of tension hoops are concentrically arranged within the eye-shaped curve.

Nodes are located on a compression ring at the intersections of the two circular arcs. Additional nodes are evenly spaced along the eye-shaped curve between the nodes located at these intersections. Compression members are located on the tension hoops such that a compression member on a first tension hoop and a proximal pair of compression members on an adjacent hoop form, in plan, the vertices of a substantially isosceles triangle. Also, compression members on an outermost tension hoop are located such that a compression member on the outermost tension hoop and a proximal pair of nodes on the compression ring form, in plan, the vertices of a substantially isosceles triangle. A plurality of tension elements interconnect each compression member on a first tension hoop to the proximal pair of compression members on an adjacent hoop. Finally, a plurality of tension elements interconnect each compression member on the outermost hoop to the proximal pair of nodes on the compression ring. This roof structure can also be modified so as to provide an opening in the middle. Again, the center structure such as the cable truss is replaced by using a pair of innermost tension hoops that are affixed to the opposite ends of the compression members.

As is apparent from the description above, the present invention is well-suited for adapting triangulated structure to a wide variety of non-circular and circular configurations. By using at least one circular arc to approximate the configuration of the underlying structure, an efficient cable arrangement is derived. By approximating an underlying non-circular configuration with a plurality of circular arcs, the triangulated geometry disclosed in the present invention may be used for a wide variety of shapes while reducing the variety of cable attachment geometries and increasing the number of attachments in which the geometry of cables arriving thereat is the same. This allows for the use of one upper attachment to be used at a plurality of upper nodes as well as one lower attachment to be used at a plurality of lower nodes.

While the invention has been described in conjunction with specific embodiments, it is evident that numerous alternatives, modifications, and variations will be apparent to those skilled in the art in light of the foregoing description.

What is claimed is:

1. A triangulated structure for supporting a roof that projects in plan a substantially closed oval curve having major and minor axes comprising:

a substantially horizontal outer compression ring;

a plurality of oval tension hoops concentrically arranged within said compression ring at different heights relative to a common reference plane;

a plurality of substantially vertical compression members each having an upper end and a lower end, defining upper and lower nodes, affixed at their lower ends to one of said oval tension hoops, said compression members being spaced apart on the tension hoops;

a plurality of tension elements interconnecting at least one of said compression members affixed to a first tension hoop to a proximal pair of said compression members affixed to an adjacent one of said tension hoops, said tension elements comprising:

a first upper tension member extending from the upper node of one of said compression members affixed to said first one of said tension hoops to the upper node of one of said proximal compression members affixed to an adjacent one of said tension hoops;

a second upper tension member extending from said upper node of said compression member affixed to said first tension hoop to the upper node of the other one of said proximal compression members affixed to said adjacent tension hoop;

a first diagonal tension member extending from said upper node of said compression member affixed to said first tension hoop to the lower node of one of said proximal compression members affixed to said adjacent tension hoop; and a second diagonal tension member extending from said upper node of said compression member affixed to said first tension hoop to the lower node of the other one of said proximal compression members affixed to said adjacent tension hoop; and means for securing an outermost one of said tension hoops and the vertical compression members attached thereto to said outer compression ring.

2. The triangulated structure of claim 1 wherein the roof extends over the entire closed oval curve.

3. The triangulated structure of claim 1 wherein the roof extends over a perimeter portion of the closed oval curve leaving the center portion of the curve uncovered.

4. The triangulated structure of claim 1 wherein said substantially closed oval curve comprises at least two circular arcs.

5. The triangulated structure of claim 4 wherein said substantially closed oval curve comprises four circular arcs.

6. The triangulated structure of claim 5 wherein the area enclosed by the substantially closed oval curve comprises:

first and second end sectors formed by first and second circular arcs, the centers of which lie on the major axis of said oval curve, equidistant from the minor axis and on opposite sides thereof; and first and second intermediate segments formed by first and second intermediate circular arcs, the centers of which are located on the minor axis of said oval curve, at a predetermined distance from said major axis and on an opposite side therefrom.

7. The triangulated structure of claim 6 wherein compression members located in said first end sector are affixed to said tension hoops at positions defined by the intersections of alternating ones of said tension hoops with alternating ones of a plurality of radial lines drawn through the center of said first circular arc; and wherein compression members located in said second end sector are affixed to said tension hoops at positions defined by the intersections of alternating ones of said tension hoops with alternating ones of a plurality of radial lines drawn through the center of said second circular arc.

8. The triangulated structure of claim 7 wherein compression members located in said first intermediate segment are affixed to said tension hoops at positions defined by the intersections of alternating ones of said tension hoops with alternating ones of a plurality of radial lines drawn through the center of said first intermediate arc; and wherein compression members located in said second intermediate segment are affixed to said tension hoops at positions defined by the intersections of alternating ones of said tension hoops with alternating ones of a plurality of radial lines drawn through the center of said second intermediate arc.

9. The triangulated structure of claim 1 wherein said compression ring comprises a plurality of nodes forming a substantially closed oval curve concentric to said outermost tension hoop.

10. The triangulated structure of claim 9 wherein said means for securing said outermost tension hoop and the vertical compression members attached thereto to said compression ring comprises a plurality of tension elements interconnecting one of said compression members affixed to said outermost tension hoop to a proximal pair of nodes on said compression ring.

11. The triangulated structure of claim 10 wherein said plurality of tension elements comprise:

a first upper tension member extending outwardly from the upper node of one of said compression members affixed to said outermost tension hoop to one of said proximal nodes on said compression ring;

a second upper tension member extending outwardly from said upper node of said compression member affixed to said outermost tension hoop to the other one of said proximal nodes on said compression ring;

a first diagonal tension member extending outwardly from one of said lower nodes of said compression member affixed to said outermost tension hoop to one of said proximal nodes on said compression ring; and a second diagonal tension member extending outwardly from said lower node of said compression member affixed to said outermost tension hoop to the other one of said proximal nodes on said compression ring.

12. The triangulated structure of claim 9 wherein said compression ring comprises a concrete box girder.

13. The triangulated structure of claim 12 wherein the location of said nodes relative to the cross-section of said girder varies around the perimeter of said compression ring.

14. The triangulated structure of claim 9 wherein said compression ring comprises a triangular truss having a horizontal top truss and a pair of inclined side trusses secured to said top truss, which extend downward from said top truss to a common point.

15. The triangulated structure of claim 1 wherein the number of compression members on each tension hoop is the same.

16. The triangulated structure of claim 1 wherein said tension elements comprise a plurality of cables.

17. The triangulated structure of claim 16 wherein each of said upper tension members comprise wire rope.

18. The triangulated structure of claim 16 wherein each of said diagonal tension members comprise wire strand.

19. The triangulated structure of claim 1 wherein said oval tension hoops comprise a plurality of cables.

20. The triangulated structure of claim 19 wherein each of said tension hoops comprise a plurality of wire strands.

21. The triangulated structure of claim 19 wherein each of said tension hoops comprise a plurality of wire ropes.

22. The triangulated structure of claim 1 further including a flexible membrane overlying said structure.

23. The triangulated structure of claim 22 wherein said flexible membrane is selected from coated with polytetrafluorethylene (PTFE) fiberglass, silicon coated polyester and corrugated steel.

24. The triangulated structure of claim 22 wherein said membrane comprises a plurality of diamond shaped panels, the vertexes of which coincide with the upper nodes of the substantially vertical compression members.

25. The triangulated structure of claim 24 wherein each of said diamond shaped panels forms a hyperbolic paraboloid when secured to said upper nodes of said vertical compression members.

26. A triangulated cable arrangement for supporting a roof having a perimeter in the shape of a closed curve with a central area, which closed curve is located in a common reference plane, said roof comprising:

a plurality of substantially horizontal tension hoops concentrically arranged at different heights relative to a common plane;

a plurality of substantially vertical compression members each having an upper end and a lower end, defining upper and lower nodes, affixed at their lower ends to one of said tension hoops, said compression members being spaced apart on the tension hoops;

a plurality of tension elements interconnecting at least one of said compression members affixed to a first tension hoop to a proximal pair of said compression members affixed to an adjacent one of said tension hoops, said tension elements comprising:

a pair of upper tension members extending from the upper node of said compression member affixed to said first tension hoop to the upper nodes of each of said proximal pair of compression members affixed to said adjacent tension hoop; and a pair of diagonal tension members extending from said upper node of said compression member affixed to said first tension hoop to the lower nodes of each of said proximal pair of compression members affixed to said adjacent tension hoop; and means for securing an outermost tension hoop to a support structure.

27. The triangulated cable arrangement of claim 26 wherein said roof extends over the entirety of the closed curve.

28. The triangulated cable arrangement of claim 26 wherein the roof extends over the perimeter of the closed curve leaving the center portion of the closed curve uncovered.

29. A triangulated cable arrangement for supporting a roof comprising:

a plurality of substantially horizontal tension hoops concentrically arranged at different heights relative to a common reference plane;

a plurality of substantially vertical compression members each having an upper and a lower end, defining upper and lower nodes, affixed at their lower ends to one of said tension hoops, wherein each compression member located on a first tension hoop and a pair of said compression members on an adjacent tension hoop form, in plan, the vertices of a substantially isosceles triangle;

a plurality of tension elements interconnecting each of said compression members affixed to a first tension hoop to said pair of compression members affixed to said adjacent tension hoop, said tension elements comprising:

a pair of upper tension members extending from the upper node of each said compression member affixed to said first tension hoop to the upper nodes of each of said pair of compression members affixed to said adjacent tension hoop; and a pair of diagonal tension members extending from said upper node of said compression member affixed to said first tension hoop to the lower nodes of each of said pair of compression members affixed to said adjacent tension hoop;

an outer compression member;

a plurality of nodes located on said outer compression member; and a plurality of tension elements interconnecting an outermost tension hoop and the compression members attached thereto to said nodes on said outer compression member.

30. The triangulated cable arrangement of claim 29 wherein the perimeter of the roof projects the underlying shape of the structure in plan.

31. The triangulated cable arrangement of claim 30 wherein the roof extends over the entirety of the underlying shape of the structure.

32. The triangulated cable arrangement of claim 30 wherein the roof extends over the perimeter of the underlying shape of the structure leaving the center portion of the structure uncovered.

33. A triangulated cable arrangement for supporting a roof having the substantial shape of a torus when projected in plan wherein the outer perimeter of the roof comprises a closed curve and the inner perimeter of the roof also comprises a closed curve, comprising:

a plurality of substantially horizontal tension hoops concentrically arranged at different heights relative to a common reference plane;

a plurality of substantially vertical compression members each having an upper end and a lower end, defining upper and lower nodes, affixed at their lower ends to one of said tension hoops, said compression members being spaced apart on the tension hoops;

an upper tension hoop affixed to the upper ends of the vertical compression members that are affixed at their lower ends to an innermost tension hoop;

a plurality of tension elements interconnecting at least one of said compression members affixed to a first tension hoop to a proximal pair of said compression members affixed to an adjacent one of said tension hoops, said tension elements comprising:

a pair of upper tension members extending from the upper node of said compression member affixed to said first tension hoop to the upper nodes of each of said proximal pair of compression members affixed to said adjacent tension hoop; and a pair of diagonal tension members extending from said upper node of said compression member affixed to said first tension hoop to the lower nodes of each of said proximal pair of compression members affixed to said adjacent tension hoop; and means for securing an outermost tension hoop to a support structure.

* * * * *